United States Patent [19]

Petersen et al.

[11] Patent Number: 4,641,787

[45] Date of Patent: Feb. 10, 1987

[54] METHOD OF COMMINUTING RARE EARTH POWDER FOR PRODUCING RARE EARTH MAGNET

[75] Inventors: Christian C. Petersen, Westwood; Ernst C. Wettstein, Acton, both of Mass.

[73] Assignee: Polaroid Corporation, Cambridge, Mass.

[21] Appl. No.: 535,867

[22] Filed: Sep. 26, 1983

[51] Int. Cl.[4] ..... B02C 19/12

[52] U.S. Cl. ..... 241/5; 241/18; 241/31; 241/275; 241/DIG. 14

[58] Field of Search ..... 241/5, 275, 17, 18, 241/40, DIG. 37, 23, DIG. 14, 31, 24, 25

[56] References Cited

U.S. PATENT DOCUMENTS

| | | | |
|---|---|---|---|
| 2,246,567 | 6/1941 | Bencowitz et al. | 241/275 X |
| 2,634,915 | 4/1953 | Fisher et al. | 241/275 X |
| 3,429,511 | 2/1969 | Budzich | 241/5 |
| 4,138,067 | 2/1979 | Planiol | 241/DIG. 14 X |

FOREIGN PATENT DOCUMENTS

| | | | |
|---|---|---|---|
| 70205 | 4/1982 | Japan | 241/172 |
| 1485448 | 9/1977 | United Kingdom | 241/DIG. 14 |

*Primary Examiner*—Mark Rosenbaum
*Attorney, Agent, or Firm*—Leslie J. Payne

[57] ABSTRACT

A method of comminuting a rare earth metallic alloy powder by impact milling for facilitating formation of an improved rare earth magnet.

13 Claims, 2 Drawing Figures

METHOD OF COMMINUTING RARE EARTH POWDER FOR PRODUCING RARE EARTH MAGNET

BACKGROUND OF THE INVENTION

This invention relates generally to the pulverizing of particulate material. More particularly, it relates to an improved way of comminuting hard, pyrophoric and oxidizable rare earth metal alloys, such as samarium cobalt, iron, etc., which comminuted materials are particularly useful for producing uniform, high quality magnets.

Several known techniques exist for reducing the size of particulate. Often when using such reducing techniques, it is highly advantageous to control the size distribution of the comminuted material. This is particularly true when manufacturing rare earth magnets. In the manufacture of such magnets it is important to reduce the particles to approximately a crystallite having a single magnetic domain. This is due primarily to the fact that the presence of such single crystallites enhance significantly the magnets' properties. More particularly, a single domain particle is easier to magnetically align in a preferred manner than a particle containing several magnetic domains.

A conventional approach for reducing rare earth particulate used in making magnets is ball milling. Ball milling, however, suffers from several rather significant drawbacks. For instance, in the ball milling process, the steel balls erode and the powder has a tendency to gall (i.e., cold weld under high pressure and friction) to metal surfaces. Galling forms surface inhomogenities, which keep small powder particles from being crushed. Therefore, the powder quality is irregular. Ball milling also suffers from the fact that it is a batch process and, therefore, is not as desirable for production as a continuous method. To avoid overheating, galling, and oxidation, toluene is used. Consequently, the ball milled powder must be subsequently dried. The heating and transfer steps associated with the drying enhance oxygen pick-up. Furthermore, it is difficult to keep toluene free from oxygen and water. As a result, the powder oxidizes to a degree higher than that desired. Oxidation is detrimental to obtaining magnetic characteristics as high and uniform as possible. This is thought to be because the oxides of these rare earth powders have relatively poorer magnetic qualities than the non-oxide material. Moreover, for high quality magnets, the proportion of ingredients in such powders, as metallic samarium cobalt, should be uniform. Oxidation, however, reduces the desired proportion between, for example, the samarium and cobalt, thereby adversely affecting the resulting strength of the magnets. Aside from the above drawbacks, ball milling is costly and labor intensive.

Attrition milling is another known process for reducing the size of rare earth powders for use in making magnets. As with ball milling it is a so-called wet, batch operation. Accordingly, it suffers from some of the drawbacks mentioned above. Hammer milling is a known dry process, but is unsatisfactory for a number of important reasons. For instance, while there is a benefit in shattering the particles with a rotating hammer, there is a rather rapid wear of the hammer.

Jet or eddy milling is a continuous and dry method of comminuting the rare earth particulate. A jet stream carries particles for impact. However, such method is relatively slow and costly. The high purity gas used is expensive (e.g., 5–10 dollars per pound of particulate) or an expensive gas recirculating system is required. Also, in some mills comminution is obtained by particles impacting against each other which is an inefficient process. In others, the gas jet blows particles against an impact surface, where they shatter. Since smaller particles are accelerated by gas jets more than larger particles, the jet mills bias production of a rather broad particle size range towards smaller diameter while the impact speed of larger particles is smaller. Therefore, the comminution of larger particles is slow and inefficient.

From the foregoing it is apparent that the known processes for comminuting particulate, especially rare earth powders possess several distinct drawbacks.

SUMMARY OF THE INVENTION

It is an object of the present invention to overcome the disadvantages associated with the comminution of hard, pyrophoric and oxidizable material, especially rare earth metal alloys, such as samarium cobalt and other magnet alloys. It is also an object of the present invention to provide for an improved rare earth magnet and method of making same.

According to the present invention, there is provided an improved method of comminuting such material. This method includes the steps of impacting the particulate against at least one impacting surface in a treatment zone by projecting the particulate at a velocity sufficient to cause comminution of at least a portion of the particulate; maintaining the treatment zone and the impact surface in a temperature range which inhibits oxidation of the particulate and which promotes particulate fracture. The method includes the step of employing an inert gaseous medium in the treatment zone for suppressing combustion of the particulate.

In a preferred embodiment of the method there is included the steps of reducing the sticking of the particulate against surfaces, which in part define the treatment zone, by providing them with a highly polished finish.

In another embodiment, the gaseous medium has significantly low concentrations of oxygen and water vapor so as to substantially reduce oxidation of the particulate. In such embodiment, the inert gaseous medium is in a temperature range which is responsible for maintaining the treatment chamber in the noted temperature range.

In yet another embodiment, there is provided an improved method of manufacturing rare earth magnets, as well as an improved rare earth magnet made by the above process.

Among the objects of the invention are, therefore, the provision of an improved method of comminuting a hard, pyrophoric and oxidizable particulate; the provision of an improved method of comminuting a rare earth alloy powder without having sticking problems; the provision of a method for comminuting material of the above type which by using a preselected temperature range inhibits oxidation of particulate and promotes particulate fracture; the provision of a method of above type which uses significantly low concentrations of oxygen and water vapor for minimizing oxidation of the particulate; the provision of a method of manufacturing rare earth magnets using the method of the above type; and, the provision of an improved rare earth magnet made by the steps including those of comminuting the particulate as mentioned above.

Other objects and further scope of applicability of the present invention will become apparent from the detailed description to follow when taken in conjunction with the accompanying drawings which like parts are designated by like reference numerals.

DETAILED DESCRIPTION

Figure 1:
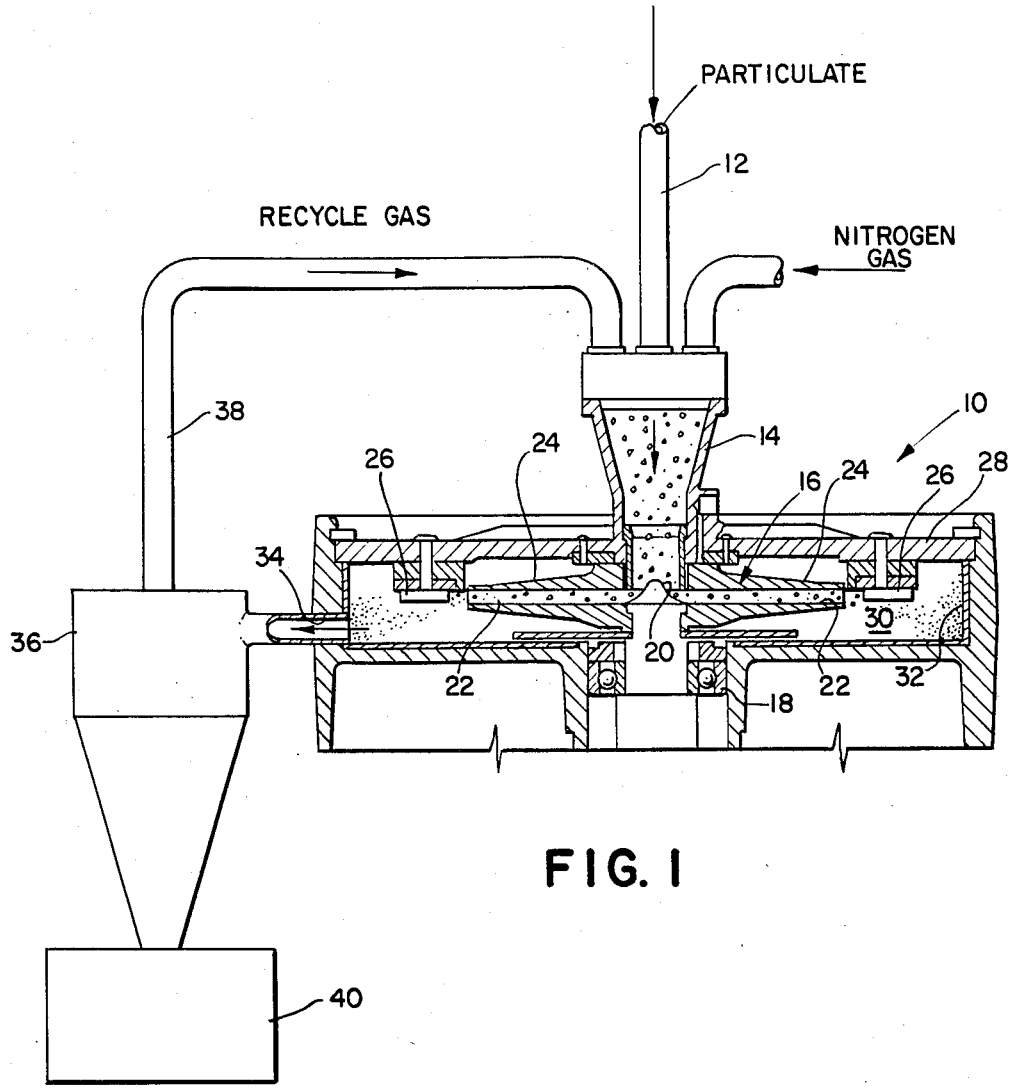
FIG. 1 is a cross-sectional view of an impact milling apparatus which comminutes the particulate in accordance with the present invention; and, FIG. 2 is a block diagram showing the sequence of steps involved in the manufacture of a rare earth magnet.
Figure 2:
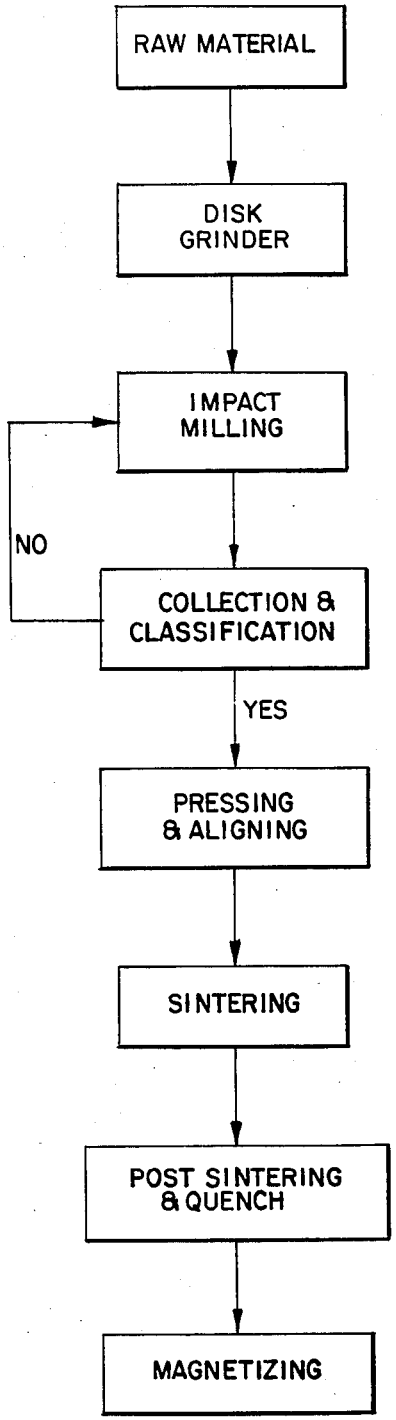

Reference is now made to FIG. 1 for showing an impact milling apparatus in which the process of comminuting hard, pyrophoric and oxidizable particulate is carried out. In this particular embodiment, the rare earth powder of samarium cobalt is pulverized and used to manufacture a samarium cobalt magnet.

The raw samarium cobalt particulate is preferably, preliminarily treated, in a disk grinder. This is for purposes of reducing the size of the particulate to facilitate comminution to the desired particle size range. The initial average particle size range of the samarium cobalt particulate, should be between about 60 mesh to 100 mesh. The input size range should be narrow if a narrow range of the milled powder is required. Smaller than 100 mesh particles are hard to produce in disk grinders and also oxidize more easily because of a larger surface to volume ratio. They are, therefore, more difficult to store and handle. Large particles might hurt the impact mill.

It is a character1stic of the impact grinders that they get less efficient for smaller particles (e.g., 1 micrometer or less). While the resistance of a particle flying in gas increases as $V^2 \times D^2$ (velocity$^2 \times$diameter$^2$), this resistance slows it down at a deceleration rate proportional to $V^2/D$. Therefore, the smaller particles slow down faster than larger ones. Also, the total impact of a particle on a solid surface goes as $V \times D^3$ and, therefore, gets much smaller for smaller particles. Particles oxidize on their surface at a rate proportional to 1/D. This means the lower number of small particles causes less oxidation than powder made by other milling methods.

Another advantage of impact milling magnetic material is that each particle impacts directly an impacting surface. The effect of secondary collision or friction between particles, which also causes rough abraded surface, is very small as compared to other milling methods such as jet, ball or attritor milling. Therefore, the particle surfaces are pure cleavage surfaces which can account for better sintering properties and also for less oxidation, because clear cleavage surfaces expose less area to the atmosphere than a rough or eroded surface.

Reference is now made to FIG. 1 for better illustrating the impact milling apparatus 10 used in the present embodiment. The 60 mesh particulate from the disk grinder is fed through an input tube 12 into a feed funnel 14. From there the particulate passes to the inlet of a rotor assembly 16. The rotor assembly 16 is journaled for rotation in a bearing assembly 18. Such rotor assembly 16 is preferably driven, by means not shown, at near sonic speeds. As will be discussed, high speed is instrumental in having the particles uniformly fracture.

A spreading element 20 separates the entering particulate into the various channels 22 formed in respective vanes 24 of the rotor assembly 16. The channels 22 extend radially through each vane 24. As the rotor assembly 16 is rotated, the controlled flow of inert gas, produced by the rotor assembly 16 and centrifugal force carries the particles radially outwardly. As the particles travel radially outwardly, they are accelerated tangentially and radially to reach maximum velocity at the rim of the vanes 24. The particulate leaves the channels 22 at an angle determined by the combined tangential and radial velocity components so as to be thrust against impact blocks 26. Impact milling of this nature allows the particulate to shatter along its cleavage surfaces.

According to the present invention, it has been determined that fracturing will be enhanced with an increase in the impact velocity of the particles. In this embodiment it is desirable to have the velocity of the particles exiting the rotor channels 22 to be at about 900 feet per second. Impact at such a velocity, especially given the relative size of the 60 mesh particulate entering the rotor 18, results in a relatively high percentage of the particulate being comminuted, after several passes through the miller, into a particle size range which on the average is between about 2 to 4 microns. Such particle size range corresponds generally to a crystallite having a single magnetic domain therein. It has been determined that anisotropic rare earth alloy powders, such as samarium cobalt, used for magnets have better magnetic characteristics when they consist of single magnetic domain particles because these particles allow for a better magnetic alignment of the powder and also because of metallurgical factors affecting the sintering process.

In this embodiment, the projected particles impact a plurality of circumferentially spaced impact blocks 26. These impact blocks 26 are connected to a top wall 28 which, in part, defines a treatment chamber or zone 30, along with a chamber wall 32. Formed in the wall 32 is a discharge port 34 for the particulate. It will be seen that the impact blocks 26 are mounted to be in the path of the projected particulate. In this particular embodiment they are made of tungsten carbide which has a hardness greater than that of the particulate being projected. It is clear then that the tungsten carbide surface will facilitate comminution of the particulate.

After the particulate strikes the surfaces of the impact blocks 26, it subsequently travels to and impinges against the chamber wall 32. The wall 32 in this embodiment is made of a highly polished hard material. In this embodiment it is made of chromium. Chromium is selected also because it possesses non-magnetic characteristics. This invention contemplates, of course, the use of other non-sticking materials, which can be highly polished and are non-magnetic. It has been determined that with the use of highly polished chromium surface there is substantially less sticking of particulate thereto subsequent to the impact of the particulate against the impact blocks 26.

As previously mentioned, samarium cobalt powder is highly oxidizable. This is deleterious from the standpoint of manufacturing high quality magnets. In this regard, oxidization of the samarium cobalt powder will create a samarium oxide. Such an oxide reduces the magnetic capability of the samarium. Furthermore, a samarium oxide reduces the desired blend or ratio between the metallic samarium and the cobalt ingredients. This also lessens the quality of the magnets produced. Thus, oxidation significantly impairs the uniform formation of high quality magnets.

It has been determined that the rate of oxidation increases exponentially with temperature increases. Since the impact milling process normally generates heat of such a nature which would undesirably increase the oxidation rate and reduce the comminution, the present invention provides a solution thereto by cooling the treatment zone 30. In this regard, cold nitrogen is inserted into the feed funnel 14 and is carried along with the particulate into the zone 30. The nitrogen is introduced at such a temperature that it will reduce the temperature in the treatment zone 30, of not only the particulate, but also of the surfaces of the impact blocks 26. For substantially minimizing oxidation the temperature in the treatment zone 30 should not, preferably, exceed 100° Fahrenheit. It is preferred to keep the treatment zone 30 and the impact blocks 26 at about room temperature or below. This relatively cool temperature for impact milling operations also enhances particle fracture. In this embodiment, it is also desirable to maintain the temperature in the bearing assembly 18 above freezing because such low temperatures might hinder performance of the bearing assembly and other temperature sensitive components. This is important because the bearing assembly 18 supports the rotor for rotation at over 25,000 rpm. Therefore, a separate gas supply can be used for treatment zone 30 and bearing assembly 18. While the treatment zone 30 should have cold gas, the bearing assembly could have gas near or above room temperature. This is because the bearing might freeze and become destroyed at lower temperatures. Thus, while the temperature in the treatment zone 30 will increase because of the impact milling operation, gas friction and adiabatic gas heating, the cool nitrogen introduced insures that the temperatures in the treatment zone 30 and the bearing assembly 18 remains at the desired noted temperature range. The present invention envisions use of much cooler temperatures in the treatment zone 30.

In addition, the nitrogen serves as an inert gaseous medium. This inhibits the pyrophoric particles from catching fire under impact.

Since oxidization is a problem as mentioned above, it is important to keep both the oxygen and water vapor concentration in the nitrogen as low as possible. In this regard, the oxygen and the water vapor concentration should be less than 100 parts per million (ppm). Preferably, the concentration should be less than about 10 ppm.

The controlled flow of the nitrogen within the treatment zone, produced by the movement of the rotor assembly 16 and other static gas jets carries the particulate to a discharge opening 34 formed in the wall 32. The particulate is transferred to a conventional cyclone type separator 36. Basically, the separator 36 separates the particles from the nitrogen. A return line 38 returns the gas to the feed tunnel 14. The cyclone separator 36 deposits the particulate into a container 40 for collection purposes. Normally, the process as stated above will result in comminuted particles having a range with the average size being about 2 to 4 microns in diameter after several passes. Such an average particle size generally corresponds to a samarium cobalt particle having a single magnetic domain. The collected particulate, at least part of which is comminuted, is subjected to a classifying step by known classifying apparatus (not shown). Thus, particles which are too large, for example, about 6 microns or larger are recycled. Particles smaller than the noted single crystallite size (e.g., 2–4 microns) can be classified out of the process. The process of the present invention yields fewer smaller than desired single crystallite particles than conventional processes. Since such smaller particles have a greater tendency to oxidize, the process of the present invention yields a substantially higher amount of unoxidized powder.

Further in accordance with the present invention, there is provided a method for using rare earth metallic alloys for producing a rare earth magnet. There are a number of ways of producing rare earth magnets. The present invention contemplates processing such particulate to form a magnet in accordance with normal practices. It will be understood that other magnetic alloys can be used for making magnets. Also, the rare earth alloys may have, of course, other elements added thereto.

In this regard, the comminuted samarium cobalt particulate of the desired size range is pressed in a press under a pressure in a range between 30,000 psi to 100,000 psi. While undergoing the pressure the material is subject to an aligning field of sufficient intensity to rotate the particles in a preferred direction parallel to the alignment field which coincides with the easy magnetic C-axis of the hexagonal samarium cobalt crystallite.

Thereafter, the pressed samarium cobalt particulate block is sintered in a furnace at a temperature in a range between 1050° C. to 1150° C. in an inert atmosphere. Samarium cobalt is normally post-sintered following the initial sintering step. This post-sintering is also done in a furnace with an inert atmosphere at about 900° C. Following the post-sintering, the samarium cobalt is quenched in a suitable quenching medium. Other rare earth alloys need not be post-sintered following the initial sintering. After quenching the pressed magnet is stable in air. Although the quenched product has not been magnetized yet, such product is normally considered to be a magnet. Thus, the term magnet as used in this application includes both the magnetized and non-magnetized quenched product. The present invention, of course, contemplates that the quenched product be magnetized in a conventional magnetizing step.

The resulting samarium cobalt magnet produced by the process mentioned above yields a high quality magnet in terms of its magnetic characteristics (e.g., strength). It is believed the fracturing of the particulate by impact milling, especially according to the steps of this invention, produces particles having uniquely formed shapes and edges which enhance production of such an improved magnet.

The operation of the method of comminuting the samarium cobalt and forming a magnet is understandable based upon the foregoing description. Also, it is believed that the present invention includes a magnet with improved magnetic characteristics which is made by virtue of the above process.

Another way to produce magnets is to press the powder dry or with plastic or metal binders. The binder may also be added by vacuum impregnation after pressing. After curing the binder, a magnet is obtained which might need not be sintered. For such magnets a compound of samarium, cobalt, iron, copper, manganese and/or other metals may be used.

Changes may be made in the above-described method and product produced by the method without departing from the scope of the invention herein involved. Moreover, it is intended that all matter contained in the description or shown in the accompanying drawings shall be interpreted as illustrative and not in a limiting sense.

What is claimed is:

1. A method of comminuting rare earth metallic particulate comprising the steps of:

impacting the particulate against at least one impacting surface in a treatment zone by projecting the particulate under centrifugal force against said surface at a velocity sufficient to cause comminution of at least a portion of the particulate;

maintaining at least the treatment zone and the impact surface in a temperature range which inhibits oxidation of the particulate while promoting fracture of the particulate; and, employing an inert gaseous medium in the treatment zone to prohibit combustion of the impacted particulate and having significantly low concentrations of oxygen and water vapor so as to substantially eliminate oxidation of the particulate.

2. The method of claim 1 wherein the particles are samarium cobalt particles and are projected at a speed of about 900 feet per second.

3. The method of claim 2 further including the step of reducing the sticking of the projected particulate against a wall, in part defining the treatment zone, by having the wall provided with a highly polished, non-sticking surface.

4. The method of claim 1 wherein said impacting step comprises comminuting the particulate so that it falls within a size range wherein the average diameter of the resulting comminuted particulate generally corresponds to a grain structure having a single magnetic domain.

5. The method of claim 4 including the preliminary step of selecting particulate in a size range between about 60 mesh to 100 mesh.

6. The method of claim 4 wherein the particulate is a samarium cobalt alloy.

7. The method of claim 2 wherein said inert gas maintains said temperature range in the treatment zone.

8. The method of claim 7 wherein said temperature range maintained in the treatment zone during impacting is up to about 100° F. so as to substantially reduce oxidation of the particulate which would otherwise increase with increases in temperature.

9. The method of claim 8 wherein the treatment chamber temperature is not allowed to rise above room temperature.

10. The method of claim 9 wherein the gas in the treatment chamber temperature does not inhibit operation of temperature sensitive components associated with the process.

11. The method of claim 7 wherein the inert gaseous medium is nitrogen introduced to said chamber at a temperature that maintains the treatment chamber within said temperature range.

12. The method of claim 11 wherein the concentration of both oxygen and water vapor is about 10 ppm.

13. The method of claim 1 wherein the concentration of oxygen is less than 100 ppm and the concentration of water vapor is less than 100 ppm.

* * * * *